United States Patent [19]

Heimgartner et al.

[11] 4,386,531

[45] Jun. 7, 1983

[54] METHOD AND APPARATUS FOR DETERMINING THE INJECTION PRESSURE DURING INJECTION OPERATIONS DURING CONSTRUCTION WORK

[75] Inventors: Hans Heimgartner, Jona; Karl Wirz, Meilen, both of Switzerland

[73] Assignee: Häni & Cie. AG, Meilen, Switzerland

[21] Appl. No.: 294,625

[22] Filed: Aug. 20, 1981

[30] Foreign Application Priority Data

Sep. 15, 1980 [CH] Switzerland ..... 6893/80

[51] Int. Cl.[3] ..... G01L 7/08; G01L 9/00

[52] U.S. Cl. ..... 73/756; 73/155

[58] Field of Search ..... 73/756, 706, 155

[56] References Cited

U.S. PATENT DOCUMENTS

| | | | |
|---|---|---|---|
| 2,189,919 | 2/1940 | Moore | 73/155 |
| 2,277,898 | 3/1942 | Andrew | 73/155 |
| 3,323,361 | 6/1967 | LeBourg | 73/155 |
| 3,478,584 | 11/1969 | Strubhar et al. | 73/155 |

*Primary Examiner*—Donald O. Woodiel

*Attorney, Agent, or Firm*—Werner W. Kleeman

[57] ABSTRACT

A pressure measuring section is arranged between a pipe section connected with an injection pump and a pipe end section or portion. The pressure measuring section is provided with a pressure measuring location which is determined by a measuring chamber arranged internally of a housing portion. Within such measuring chamber or compartment there is located a pressure-impinged portion of a pressure measuring transducer which generates electrical signals in accordance with the pressure prevailing in the injection medium. These electrical signals are inputted by a cable to a signal evaluation location. The measuring location is located in close proximity to an outlet opening of the pipe end portion or section. Between this outlet opening and the pressure measuring location there is arranged a packing device which seals the annular or ring-shaped compartment between the pipe end section and the wall of the borehole. Since the pressure measurement is accomplished internally of the infeed line or infeed line arrangement for the injection medium there is obtained a measuring result which is not falsified. Because of the close proximity of the measuring location to the injection location the measured pressure is essentially equal to the injection pressure at the injection location.

4 Claims, 2 Drawing Figures

METHOD AND APPARATUS FOR DETERMINING THE INJECTION PRESSURE DURING INJECTION OPERATIONS DURING CONSTRUCTION WORK

CROSS REFERENCE TO RELATED APPLICATION

This application is related to our commonly assigned copending U.S. application Ser. No. 168,061, filed July 14, 1980 and the commonly assigned copending U.S. application Ser. No. 294,624, filed Aug. 20, 1981, entitled "Apparatus for Delivering a Pressurised Medium Conveyed at Variable Pressure by a Pump Device".

BACKGROUND OF THE INVENTION

The present invention relates to a new and improved method of, and apparatus for, determining the injection pressure during injection operations performed during construction work.

Generally speaking, the method and apparatus of the present invention rely upon measuring the pressure of the injection medium by means of a pressure measuring device.

In order to determine the injection pressure within boreholes it is already known in this technology to determine by computations the injection pressure. This is accomplished by taking into account the pressure generated by the injection pump and the characteristics of the inflow line leading to the boreholes and through which flows the injection medium. Since the magnitudes needed for such computations are not always sufficiently accurately known and, under circumstances, can fluctuate during the injection operation, it is not possible to determine in this fashion with sufficient accuracy the injection pressure.

Equally, it is known from Swiss Pat. No. 609,423 to arrange at the outlet of a distribution compartment or chamber, coupled with a pump device, within each outbound line a throughflow regulation valve and a measuring device for measuring the pressure prevailing downstream of such regulation valve. However, the measuring devices are located at an appreciable distance from the injection site or location, so that the pressure measured by such measuring devices only approximately corresponds to the injection pressure prevailing in the boreholes.

In order to be able to detect the actual pressure prevailing at the injection site it has already been proposed to arrange a pressure measuring device forwardly of the outlet opening of the infeed line arrangement. This pressure measuring device is impinged or has flowing therearound the injection medium effluxing from the infeed line arrangement or infeed line. Since the pressure measuring device is located completely within the flow of the injection material the danger exists that material will deposit at dead spaces and at the supports or holders by means of which the pressure measuring device is connected with the infeed line arrangement. Additionally, the flow of the injection medium is disturbed by the pressure measuring device. It is for these reasons that the obtained measurement results are falsified and, thus, do not portray the desired accurate picture of the injection pressure. Furthermore, there is also present the danger that the pressure measuring device will remain anchored in the borehole due to solidification of the injection material and no longer can be removed from such borehole in conjunction with the infeed line arrangement.

SUMMARY OF THE INVENTION

Therefore, with the foregoing in mind it is a primary object of the present invention to provide a new and improved method of, and apparatus for, determining the injection pressure during injection operations occuring during construction work in a manner not associated with the aforementioned drawbacks and limitations of the prior art proposals.

Another and more specific object of the present invention is directed to a method and apparatus of the previously mentioned type which enables, with the use of very simple means and in a most reliable manner, the determination in as accurate fashion as possible of the injection pressure which actually prevails at the injection site.

Still a further significant object of the present invention aims at providing a new and improved construction of apparatus for determining the injection pressure prevailing at an injection site during construction work, which apparatus is relatively simple in construction and design, extremely reliable in operation, not readily subject to breakdown or malfunction, and requires a minimum of maintenance and servicing.

Now in order to implement these and still further objects of the invention, which will become more readily apparent as the description proceeds, the method of the present development for the determination of the injection pressure during injection work accomplished at construction sites, is manifested by the features that the pressure measurement occurs internally of the infeed line for the injection medium at a location which, viewed with respect to the direction of flow of the injection medium, is positioned forwardly of a seal which closes the annular or ring-shaped space between the infeed line and a wall surrounding such infeed line.

As already indicated heretofore the invention is also concerned with apparatus for the performance of the aforementioned method. According to a preferred constructional design of the invention such apparatus contains a pressure measuring device which measures the pressure internally of the infeed line for the injection medium. This pressure measuring device is arranged at a location which, viewed with respect to the direction of flow of the injection medium, is upstream or forwardly of a seal which obturates the ring-shaped chamber or space between the infeed line and a wall surrounding such infeed line.

In an attempt to determine as accurately as possible the injection pressure at the injection location or site the measuring location, while located in close proximity to the outlet of the infeed line, nonetheless is not arranged at the outlet itself. Due to the provision of the pressure measuring location behind the packing arrangement (borehole seal), viewed with respect to the space where the injection material is to be injected, and preferably at the neighbourhood of such parking arrangement, the measuring location is protected from being acted upon by the injection medium effluxing out of the infeed line. At the pressure measuring location it is possible to control without any difficulty the flow and measuring conditions, so that there do not arise any undesired and uncontrollable falsification of the measurement results. Since the measuring location is located quite close to the outlet of the infeed line, i.e. near to the injection location or site, there is determined with extreme accuracy the actual injection pressure prevailing at this injection site. The relatively short distance between the measuring location and the injection site does not appreciably impair the conclusions which can be drawn from or the determinations which can be made from the measuring results.

In the event that the infeed line for the injection medium contains a measuring chamber or compartment, within which there is arranged the pressure-impinged portion or section of the pressure measuring device, then there is preferably provided in such measuring chamber a device or structure for mixing or placing into turbulence the inflowing injection material. By virtue of the turbulence or agitation caused by such structure the injection material within the measuring chamber is maintained in motion. Consequently, there is ensured that at the pressure-impinged portion or section of the pressure measuring device there always is available a flow of injection material and at the region of such pressure-receiving or pressure-impinged portion there cannot form any dead zones, and specifically, also not then when the pressure-receiving portion, viewed in the flow direction, is positioned laterally of the inlet opening of the measuring chamber.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
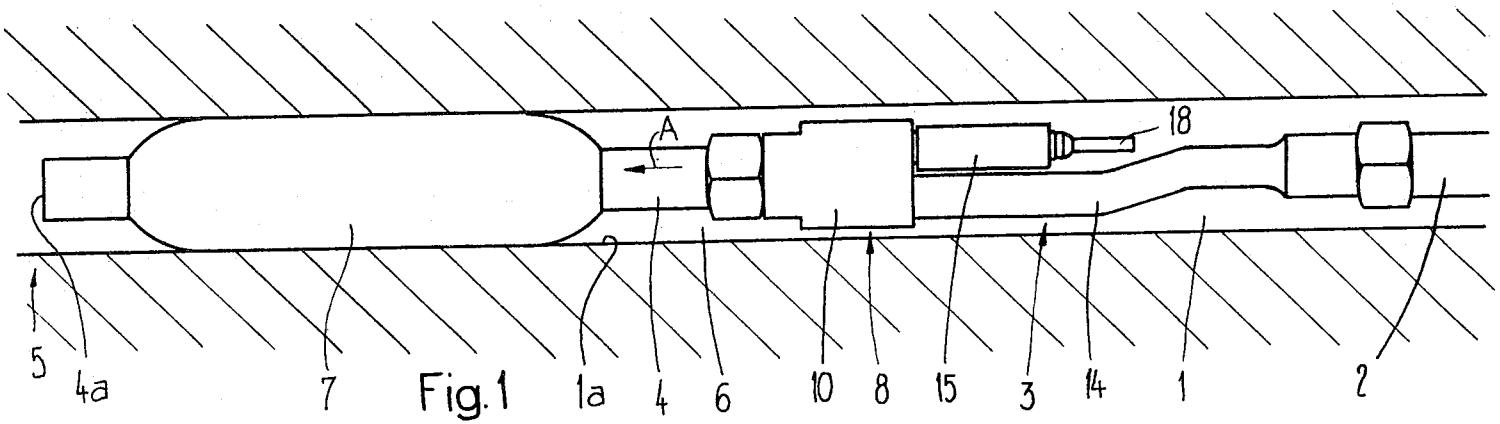
FIG. 1 illustrates an apparatus for the injection of an injection medium and containing a measuring device for measuring the injection pressure and which apparatus is located in a borehole.

Describing now the drawings, in FIG. 1 there is illustrated the outlet end within a borehole 1 of an infeed line or infeed line arrangement for a conventional injection medium which, for instance, can consist of an aqueous suspension formed on the basis or mortar or cement. The injection medium is conveyed by a not particularly illustrated but conventional injection pump through the infeed line to the borehole 1 from the pipe or tube section which has been designated by reference character 2. Merging with this pipe section or portion 2 is a pressure measuring portion or section 3 which is threadably connected with such pipe section 2 and the construction of which will be described more fully hereinafter. By means of a further thread connection there is coupled a pipe end portion or section 4 with the pressure measuring portion 3. The pipe end section or portion 4 contains an outlet or discharge opening 4*a* for the injection material. This outlet opening 4*a* is located at the region of the injection location or site 5. The annular or ring-shaped chamber or space 6 formed between the pipe end section 4 and the borehole wall 1*a* is sealed in conventional manner by means of a packer or packing arrangement 7. This packer 7 can consist of, for instance, a collar which can be expanded by means of compressed air.

Figure 2:
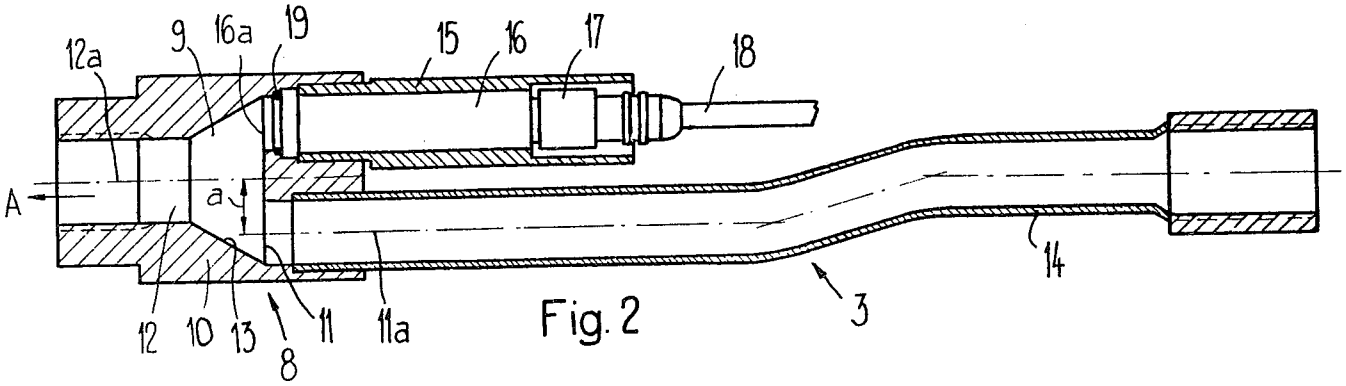
FIG. 2 is a sectional view on an enlarged scale in relation to the showing of FIG. 1 and illustrating the pressure measuring section or portion of the apparatus depicted in FIG. 1.

In the pressure measuring section 3 there is located a pressure measuring location 8 at which there is measured the pressure within the infeed line for the injection medium. At this measuring location 8 there is provided a measuring chamber or compartment 9, as best seen by referring to FIG. 2, which is arranged internally of a housing portion 10. This measuring chamber 9 convergingly tapers in the flow direction A of the injection medium and possesses an elliptical cross-sectional configuration. The major axis of such elliptical cross-section is located in the plane of the drawing of FIG. 2. The measuring chamber 9 contains an inlet opening 11 and an outlet opening 12. The outlet opening 12 is laterally offset in relation to the inlet opening 11, i.e. the axis 11*a* of the inlet opening 11 extends at a spacing a with respect to the axis 12*a* of the outlet or discharge opening 12. The wall portion 13 of the measuring chamber 9 which extends from the inlet opening 11 to the outlet opening 12 functions as a deflection surface for the injection medium which enters the measuring chamber 9 through the inlet opening 11.

Inserted into the housing portion 10 is one end of a pipe section or portion 14, the other end of which is coupled with the pipe section or portion 2, as best seen by referring to FIG. 1. Since the axis 11*a* of the inlet opening 11 is offset in relation to the axis of the pipe section or portion 2, the pipe portion 14 possesses a curvature. Neighbouring the pipe portion or section 14 and extending approximately in parallelism therewith there is arranged a sleeve member 15 which is threadably connected into the housing portion 10. This sleeve member or sleeve 15 is open at both ends. Internally of such sleeve 15 there is arranged a pressure measuring transducer 16 or equivalent structure, the pressure-impinged membrane or diaphragm 16*a* of which confronts the measuring chamber or compartment 9. This pressure measuring transducer 16 is of conventional design and generates electrical signals which are predicated upon the pressure acting upon the diaphragm or membrane 16*a*. These electrical signals which are produced are proportional to such exerted pressure. By means of a plug 17 or the like a cable 18 is connected with the pressure measuring transducer 16. There are infed by means of such cable 18 the pressure-proportional signals to a measuring value processing station located externally of the borehole 1, at which for instance there can be accomplished a pressure display or pressure recording, for instance as disclosed by the system of our aforementioned copending U.S. application Ser. No. 294,624, filed Aug. 20, 1981. As best seen by referring to FIG. 2, between the housing portion 10 and the pressure measuring transducer 16 there is arranged a sealing ring 19.

By means of the pressure measuring transducer 16 there is thus measured in known manner the pressure of the injection medium flowing through the infeed line sections 2, 14 and 4 towards the injection site or location 5. To avoid the formation of a dead-flow zone at the region of the diaphragm or membrane 16*a* of the pressure measuring transducer 16, which is arranged approximately at the same height and laterally of the inlet opening 11, the injection medium within the measuring chamber 9 is continuously maintained in motion. This is accomplished by the previously explained lateral displacement of the inlet opening 11 and outlet opening 12. The injection medium arriving from the pipe portion 14 and entering the measuring chamber or compartment 9 through the inlet opening 11 impinges at an inclined extending wall portion 13 of the measuring chamber 9 and thus experiences a deflection. This causes a beneficial agitation or turbulence of the injection medium within the measuring chamber or compartment 9. In this manner there is thus continuously maintained in motion the injection medium located within the measuring chamber 9, and specifically, also at the region of the diaphragm 16*a*. Consequently, there is not only ensured for a faultless measurement, but also there is precluded that there will be formed material depositions within the measuring chamber at flow-dead zones or regions thereof. It should be readily understood that it is possible to maintain in motion the injection medium within the measuring chamber 9 in a manner different than heretofore described by way of example and not limitation.

Since the measuring location is disposed internally of the infeed line for the injection medium, there are known the flow and measuring conditions and such are essentially always constant, so that it is possible to carry out an unfalsified measurement of the pressure in the injection medium. Since the measuring location 8 additionally is located quite close to the injection location 5, the measured pressure corresponds practically to the injection pressure which actually prevails at this injection location or site 5. The relatively slight spacing between the measuring location 8 and the injection location 5, which for instance can amount to approximately 1 meter, only has an insignificant affect upon the accuracy of the measurement or measuring results.

Since the pressure measuring portion or section 3, viewed from the location of the injection site 5, is disposed behind the packing arrangement 7, the pressure measuring portion 3 is protected against the action of the injection medium effluxing out of the outlet or discharge opening 4. The pressure measuring portion 3 therefore is protected against damage by the injection medium. Additionally, there is advantageously avoided any undesired fixation of the pressure measuring portion 3 within the borehole 1 due to solidified injection material. It can be advantageous to provide a reference fracture location between the pressure measuring portion 3 and the packing arrangement or packer 7, which upon reaching a certain tensile load renders possible separation of the pressure measuring portion 3 from the pipe end portion or section 4. In this way it is possible to remove the pressure measuring portion 3 out of the borehole 1 even then when the packer 7 is fixedly seated in the borehole 1 and no longer can move out of such borehole. Since the pipe portion 14 and the pressure measuring transducer 16, viewed in the direction of material flow A, are located adjacent one another and arranged so as to extend essentially parallel to one another, there is realised a space-saving construction which enables placement of the pressure measuring portion 3 also within boreholes 1 having a relatively small diameter. To the extent that the available space allows the pressure measuring transducer 16 also can be arranged at a different location.

While there are shown and described present preferred embodiments of the invention, it is to be distinctly understood that the invention is not limited thereto, but may be otherwise variously embodied and practiced within the scope of the following claims. Accordingly,

What we claim is:

1. A method for determining the injection pressure during injection operations performed during construction work, comprising the steps of:

providing an infeed line for infeeding an injection medium flowing in a predetermined direction to an injection site;

said infeed line containing a seal closing a ring-shaped space between the infeed line and a wall surrounding said infeed line; and taking the pressure measurement internally of the infeed line at a location which, viewed with respect to the direction of flow of the injection medium, is situated upstream of the seal closing the ring-shaped space between the infeed line and the wall surrounding said infeed line.

2. The method as defined in claim 1, further including the steps of:

taking the pressure measurement at a location neighbouring the seal.

3. An apparatus for determining the injection pressure during injection operations of an injection material during construction work, comprising:

a pressure measuring device for measuring the pressure of the injection medium;

infeed line means for infeeding the injection medium so as to move in a predetermined direction of flow towards said pressure measuring device;

said infeed line means being provided with seal means for closing a substantially ring-shaped space between said infeed line means and a wall of the construction site surrounding said infeed line means; and said pressure measuring device being arranged at a location which, viewed with respect to the direction of flow of the injection medium, is located upstream of said seal means which closes said ring-shaped space between the infeed line means and said wall surrounding said infeed line means.

4. The apparatus as defined in claim 3, wherein:

said pressure measuring location is arranged neighbouring said seal means.

* * * * *